United States Patent [19]

Baulard-Caugan

[11] 4,385,579

[45] May 31, 1983

[54] SAILING CRAFT

[76] Inventor: Gerard Baulard-Caugan, Dauphine-Pavillon Du Barry, 78439 Louveciennes, France

[21] Appl. No.: 172,933

[22] Filed: Jul. 28, 1980

[30] Foreign Application Priority Data

Jul. 27, 1979 [FR] France ..... 79 19414
Jul. 27, 1979 [FR] France ..... 79 19414

[51] Int. Cl.[3] ..... B63B 15/00; B63H 9/10

[52] U.S. Cl. ..... 114/91; 114/39; 114/128; 114/132; 114/102

[58] Field of Search ..... 440/14, 15; 114/39, 114/91, 124, 126, 127, 128, 132, 135–137, 140, 142, 143, 56, 102, 103, 89, 90

[56] References Cited

U.S. PATENT DOCUMENTS

| | | | |
|---|---|---|---|
| 559,983 | 5/1896 | McLean | 114/91 |
| 3,086,492 | 4/1963 | Holley | 440/15 |
| 3,173,395 | 3/1965 | Laurent | 114/102 |
| 3,491,997 | 1/1970 | Winters | 440/15 |
| 3,828,711 | 8/1974 | Russell | 114/103 |
| 4,044,703 | 8/1977 | Kurtz | 114/136 |
| 4,067,280 | 1/1978 | Serfess | 114/128 |
| 4,094,263 | 6/1978 | Marcil | 114/91 |

*Primary Examiner*—Trygve M. Blix
*Assistant Examiner*—D. W. Keen
*Attorney, Agent, or Firm*—Steinberg & Raskin

[57] ABSTRACT

A sailing craft of the type which includes a floating hull, a mast secured to the hull, a sail mounted on the mast and rudder means, wherein the mast is pivotally mounted with an articulation near but spaced from the base thereof with respect to a substantially horizontal axis, and a pair of mobile fins having variable lift movably mounted, each on a respective one of the port and starboard sides of the hull, and a linkage interconnecting the mast and the mobile fins for actuating the fins such that they act in the water in a manner so as to tend to right the hull under the dynamic action of water on the fins in a direction opposite to the direction in which the mast pivots, and in which the craft would normally heel under the action of the wind to which it is exposed.

11 Claims, 6 Drawing Figures

SAILING CRAFT

The object of the present invention is essentially, a sailing craft of the type comprising a floating hull, a mast secured on this hull, a sail mounted on the mast, and a means for steering the craft. Such a definition fits, in particular, sailboats, whether with ballasted keel or center-board, and sailing plank.

One of the basic difficulties in the working of such craft is that the wind required to move the vessel forward obviously has a tendency to overturn the craft, so that it is constantly necessary to fight this tendency. On large sailboats the ballasted keel does this job. On light, center-board craft, and on sailing planks, the helmsman must serve as a counterweight with his body by selecting, at each moment, the optimum degree of heel for obtention of the best performance in forward movement.

The sailing craft according to the invention is characterized essentially, with respect to the known state of the art, in that the said mast is mounted with an articulation near its base, around a substantially horizontal axis turning in a structure integral with the hull, and the said mast is connected to means for actuating the mobile fins, centerboard or the like, which act in the water in such a way as to tend to right the hull in a direction opposite the direction in which the mast is leaning, and in which the craft would normally lean under the action only of the wind to which it is subjected.

It will immediately be understood that by creating such a combination of means, the craft automatically counteracts the heel that it could assume, the righting of the fins automatically being directly proportional to the action of the wind tending to push the craft over. Under these conditions, there is no longer any need for a heavily ballasted keel, or for spectacular but not always effective acrobatics, to right the craft against the wind.

According to a preferred embodiment of the invention, the base of the mast, as it oscillates around its axis of articulation, moves transversely to port or starboard, and at the same time entrains a transverse bar, at each end of which there is articulated a connecting rod at which end opposite the articulation on the said transverse bar is integral with a substantially vertical pivot articulated in a structural element fixed to the hull, and around which one said fin, on the starboard or port side, respectively, can rotate. Advantageously, in a substantially vertical position of the mast, the said port and starboard fins have a substantially zero, and, preferably, a slightly positive, life, while in the position of the mast inclined to port, the said port-side fin has a substantially positive lift, while the said starboard fin has a substantially negative lift, and, likewise, with the mast inclined to starboard, the said port fin has a substantially negative lift while the said starboard fin has a substantially positive lift.

In this way, extremely simple mechanism means can insure the automatic and effective righting of the craft, whatever the force of the wind and its changes.

According to another characteristic of the invention, the sails comprise two substantially symmetrical, triangular parts fixed to the said mast with a sheet to hold each sail being attached to the lower free end of the sail not fixed to the mast, each sheet passing over a single pulley fixed to the end of an arm that can be oriented to port or to starboard. In addition, the craft comprises a lever articulated around a horizontal axis in the median longitudinal plane of the craft, and rotatable on itself, the said lever terminating at its upper end in an operating handle and at its lower end in a plane with general shape of a shark's tail. This shark's tail advantageously replaces the rubber blade, while the lever advantageously replaces the helm, making it possible to obtain not only a change in direction of the craft, but also to act on the heel, supplementing the automatic means mentioned above, and also to insure a braking or a drogue anchor action as desired.

Other characteristics, objects and advantages of the invention will appear more clearly with the aid of the description which follows, given in reference to the attached drawings, presenting solely by way of example, a method of application and embodiment of the invention. In these drawings.

Figure 1:
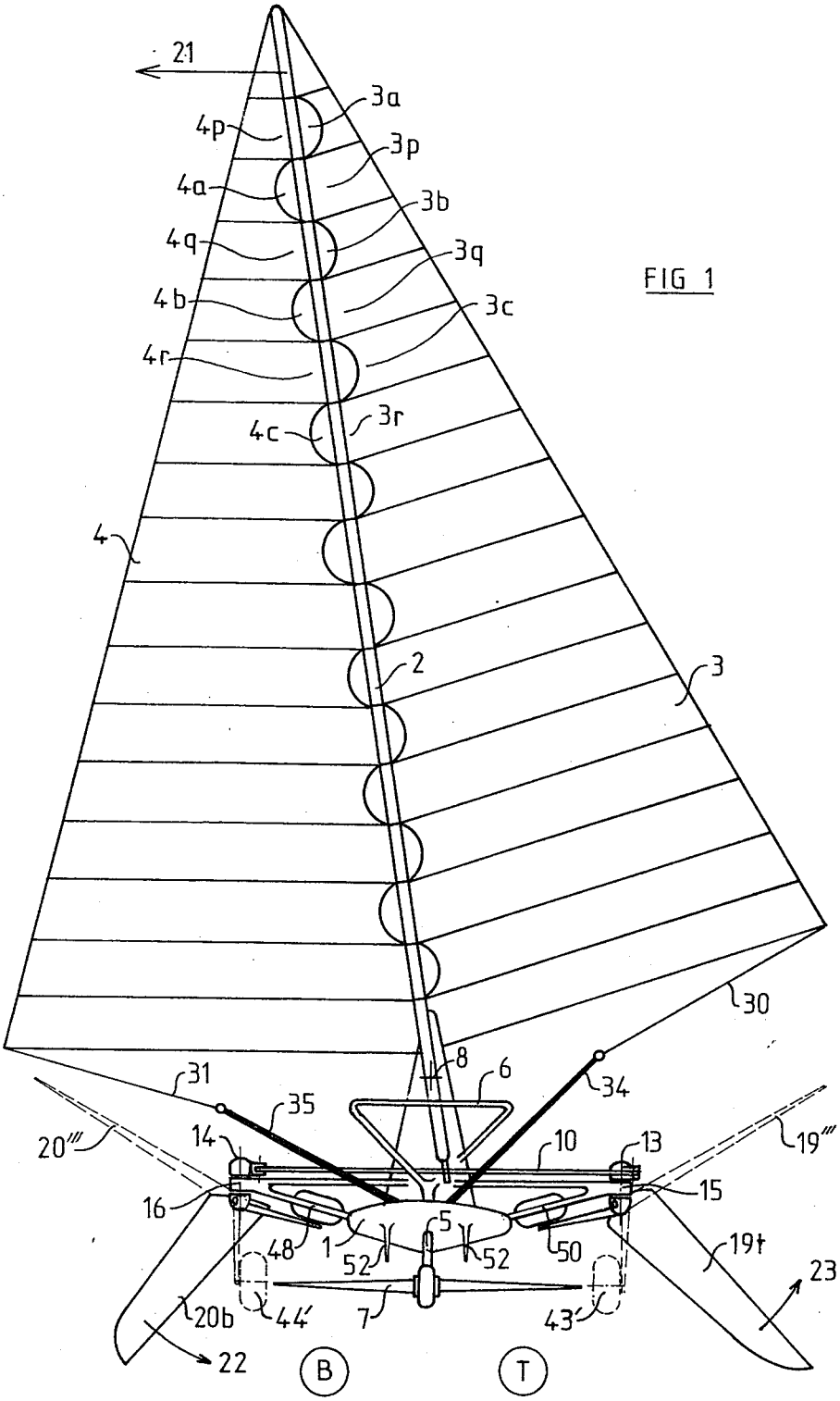
FIG. 1 is a schematic view from the stern of a craft according to the invention.

According to the embodiment illustrated in the drawings, the craft comprises, essentially, a floating hull 1, a mast 2, secured on this hull, a sail comprising two parts 3, 4, mounted on the mast, and a rudder means comprising, essentially a lever 5, an operating handle 6 for this lever, and a dolphin-tail rudder plane 7.

According to an essential characteristic of the invention, the mast 2 is mounted with an articulation near its base, around a substantially horizontal axis 8, rotating in a structure 9 integral with the hull 1.

The base 2*a* of mast 2, as it oscillates around its axis of articulation 8, moves transversely to port (marked B in the drawing) or to starboard (marked T in the drawing ) and at the same time entrains a transverse bar 10.

At each end 10*t* and 10*b* of bar 10, there is articulated a connecting rod 11, 12, respectively, whereof the end opposite the articulation on the said transverse bar, is integral with a substantially vertical pivot 13, 14, respectively, which rotates while being articulated in a structural element of the hull, i.e. in the example illustrated, at the apexes 15, 16, of two triangles formed with central openings 17, 18 on each side of the hull.

On pivot 13 and on pivot 14 there are mounted fixedly two fins, a starboard fin 19*t* and a port fin 20*b* respectively.

The simple mechanical linkage just described, automatically insures, when mast 2 oscillates around its axis of articulation 8, movements to the front or to the rear, of fins 19, 20. FIG. 1, shows, by arrow 21, the direction in which mast 2 is inclined, and by arrows 22, 23, the corresponding directions of rotation of fins 20, 19. Likewise in FIG. 2, when the mast leans in direction 24, the fins 19, 20, rotate, respectively, in the directions of arrows 25, 26.

Figure 2:
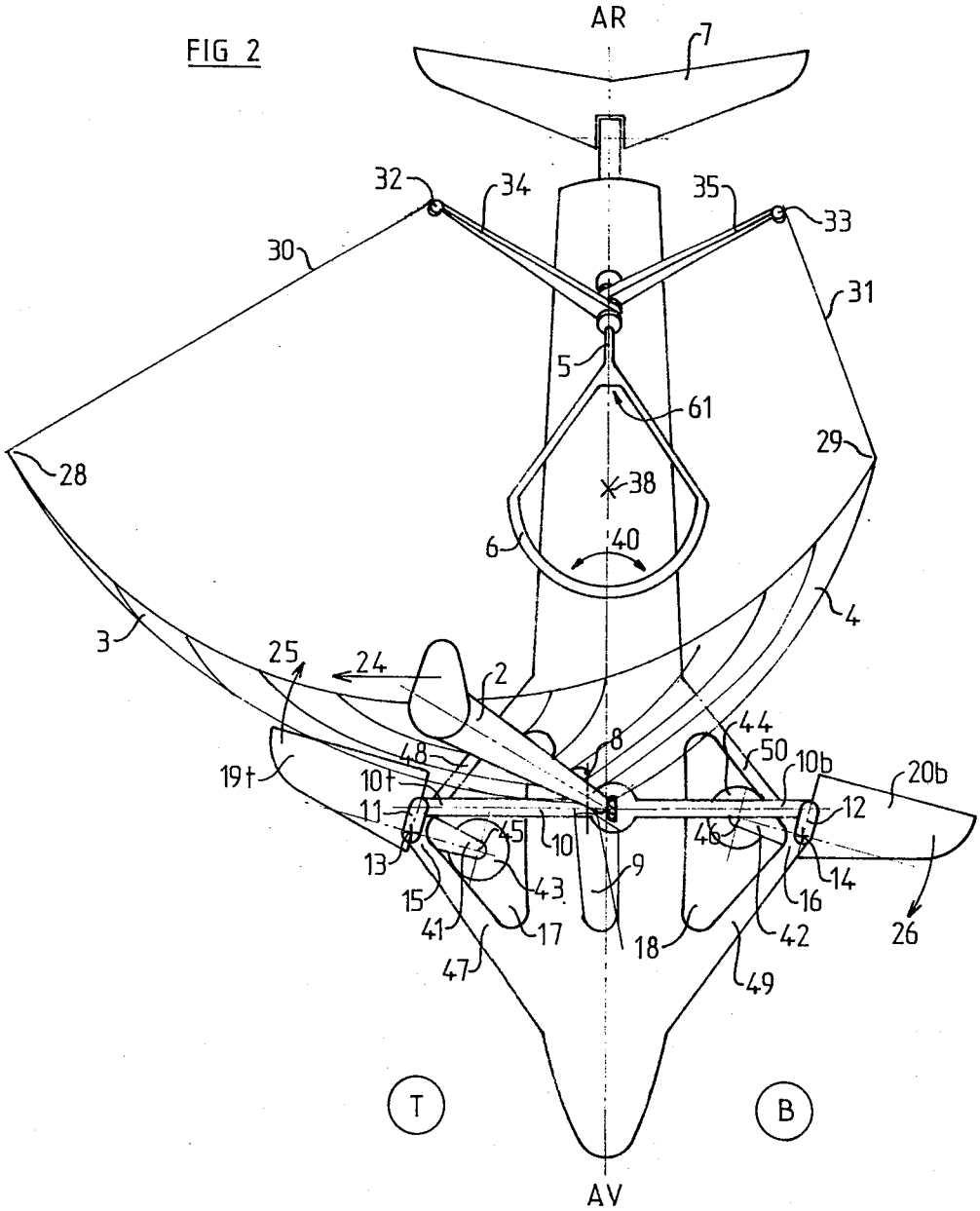
FIG. 2 is a view from above of the craft illustrated in FIG. 1, and in substantially equivalent configuration, to the angle of heel close to the mast.
Figure 4:
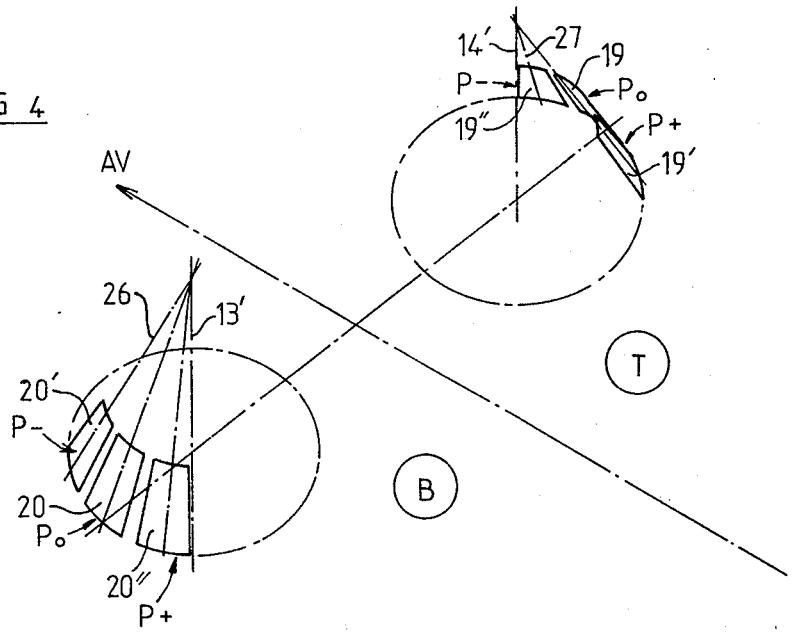
FIG. 4 is a schematic view illustrating the principle of actuation of the fins.

As it appears more clearly and schematically in FIG. 4, in which the axis AV–AR indicates the median direction of advancement of the craft, when the mast oscillates around axis 8 (not shown in this figure) the two fins 19, 20, rotate around vertical axes 13', 14' while remaining tangent to two cones 26, 27 with axes 13', 14', and generatrixes parallel to the plane of setting selected for the fins. In FIG. 4, the fins have been schematically illustrated by small rectangular surfaces marked 19, 20 in the neutral, or vertical position of the mast. When the mast leans, for example, to starboard (as illustrated in FIG. 2), the starboard fin 19 moves to the rear 19', exposing its inner face to the streams of water, thus having a positive lift, counteracting the list to starboard of the vessel. At the same time, portside fin 20 moves forward to 20', exposing its outer or upper face to the streams of water, thus having a negative lift, again counteracting the list to starboard of the vessel. In similar fashion, when the mast leans to port (as illustrated in FIG. 1), port fin 20 moves to the rear 20'', exposing its inner or lower face to the streams of water, thus having a positive lift counteracting the list to port of the craft. At the same time, starboard fin 19 moves forward at 19'', exposing its outer or upper face to the streams of water, thus having a negative lift counteracting the list to port of the craft. In the same FIG. 4, letter P, indexed zero (PO) marks the substantially zero lift of fins 19, 20, in the neutral position of the craft. The setting of the fins will advantageously be made in such a way that this lift will not be exactly zero, but slightly positive. In the same figure, the letter P+ shows the positive lift of fins 19, 20 in positions 20'' and 19' respectively. Likewise the letters P− indicate the negative lifts in the positions of the fins illustrated at 20' and 19''. Thus the fundamental operating principle of a craft according to the invention is made quite clear.

Other characteristic elements of the craft will now be described.

First of all, as mentioned above, the sail comprises, essentially, two triangular sails 3, 4, which are mounted fixedly to the mast 2 in any appropriate fashion, for example, as a sheath alternating with openings opposite one another like hinges.

If the craft "beats" to windward, the two parts 3 and 4 are folded onto one another and form a sort of sail of the rather conventional triangular type. But if the craft is running before the wind, the two parts of the sail open as seen in FIGS. 1 and 2, forming a sail with "two slabs". The openings *4a*, *4b*, *4c*, etc. spaced on sail part 4 and contiguous to attachment parts *4p*, *4q*, *4r*, etc. of part 4 form vent channels for the air between the mast and the edge of the sail attached to the mast. In the same manner, openings *3a*, *3b*, *3c*, etc. on sail part 3, contiguous to the points of attachment *3p*, *3q*, *3r*, of part 3 form vent channels for the air. In such a configuration, when running before the wind or with a quartering wind, the air is better channeled and fills the sail better, improving its efficiency. A very beautiful esthetic effect can be imparted to this sail if each part 3, 4 is two-colored, the portside sail having different colors from the starboard, and the appearance of the craft will change with its direction of movement, its speed, and the point of observation.

To hold the base of the sail, there is no need for a boom, and it will be advantageous merely to use a sheet that will be attached to the bottom peak of the triangle formed at 28, 29 on each sail part 3, 4. Sheets 30, 31 will be run over guide pulleys, 32, 33, for example, fixed to the free ends of two arms 34, 35, that can be oriented to port and to starboard on the stern of the craft.

Figure 3:
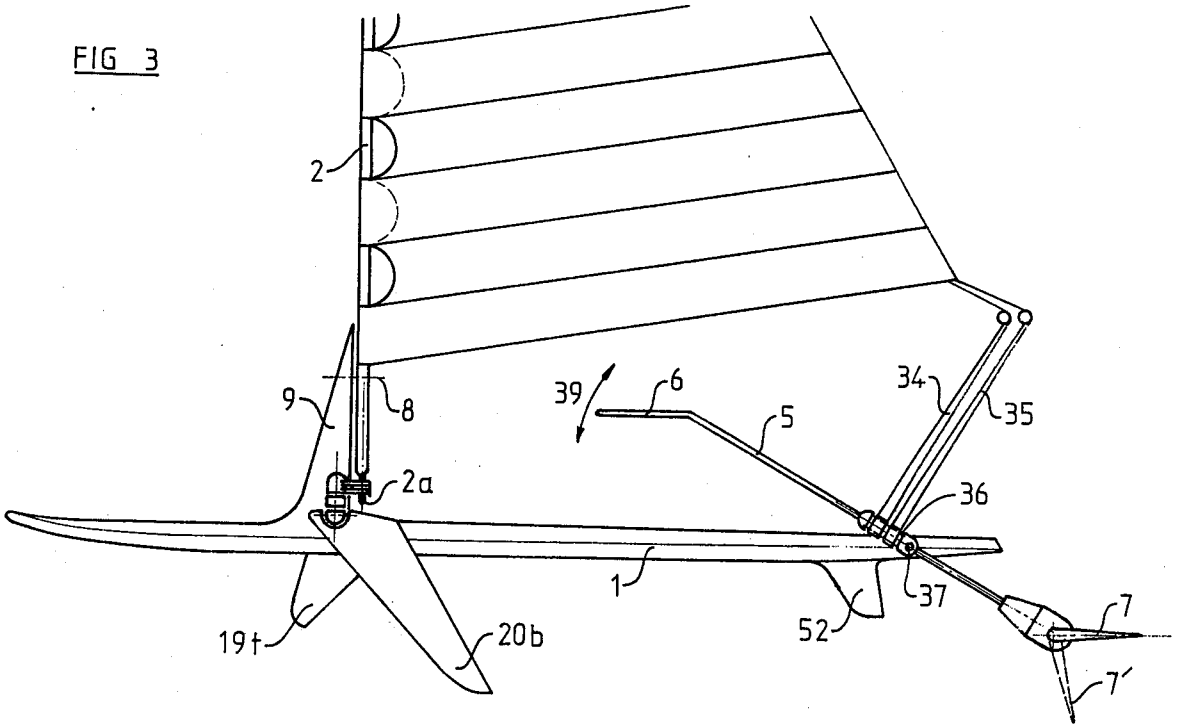
FIG. 3 is a side view of the same craft, only part of the sail height being shown.

In the example of embodiment illustrated, the arms 34, 35 are mounted on a sleeve 36, around which they can be oriented by being inclined more or less to port or to starboard. Sleeve 36, in turn, is articulated around a horizontal pivot 37, suitably mounted on hull 1 (FIG. 3).

Now the operating lever of the craft will be described.

As mentioned above, lever 5 terminates at one end in an operating handle 6 and at its other end in a dolphin-tail rudder plane 7. The form of lever 6 permits the user to place himself, where the case applies, at 38 (FIG. 2) in the center of the lever.

Lever 5 is mounted freely rotatable in the interior of sleeve 36 described above. Actuation of operating handle 6 according to double arrow 39 (FIG. 3) therefore makes it possible to alter the depth and the angle of attack of rudder plane 7.

A rotation of the lever on itself according to double arrow 40 (FIG. 2), makes it possible at the same time to turn the craft to port or starboard just like a fish.

The rudder plane which always remains completely immersed, is much more efficient than a conventional rudder would be. Moreover it forms a plane of "grip" for the craft which becomes very efficient at high speed.

A complete 180° turnover according to arrow 40 (FIG. 2) of the lever causes plane 7 to assume the position 7' (FIG. 3) forming an extremely powerful braking effect, and perhaps a drogue anchor for bad weather.

Returning now, more particularly to FIGS. 1 and 2, the means for limitation and damping of the tilt of the mast and of the conjugated movement of the fins 19, 20, will now be described.

As illustrated in the drawings, fins 19, 20 are mounted on pivots of articulation 13,14 at the apexes 15, 16 of hollow triangles formed in the hull. On these same pivots 13, 14 there are mounted two arms 41, 42 each one bearing a pneumatic tire 43, 44 mounted on a pivot 45, 46 of arm 41, 42. Tire 43, 44, in the normal operating position of the craft as illustrated in FIGS. 1 and 2, swings inside triangular openings 17, 18 between connecting arms 47, 48, 49, 50 linking the apexes 15, 16 of the triangles of the hull. Thus, when mast 2 oscillates around its axis 8, it entrains transverse bar 10 to port of starboard, causing the rotation of fins 19, 20 and arms 41, 42 bearing the pneumatic tires 43, 44 forming elastic stops damping and stopping the movement of inclination of the mast within sides 47, 48, 49, 50 of the swing traingles 17, 18. It should be noted that the inflation pressure of tires 43, 44 can be selected so as to adjust as desired the hardness of the stops and, to a certain extent, the permitted angle of swing. In addition, these tires form floats helping to give the craft durability and make it insubmersible.

As it appears in FIG. 1, it can also be seen that if the assemblies constituted on the one hand by fin 19, arm 41 and tire 43, and, on the other hand, by fin 20, arm 42 and tire 44, are mounted articulatedly on a horizontal pivot (not shown), perpendicular, respectively, to pivots 13 and 14, it becomes possible, by pivoting the two assemblies around the said horizontal pivots, to bring the wheels into the position illustrated at 43', 44', and in this position the craft can be moved along the ground. In this position, fins 19, 20 are raised as shown at 19''', 20'''. Naturally, a simple means will be provided for locking the fins and the tires 43, 44 in a suitable angular position, either for transportation or for use at sea.

As seen in FIGS. 1 and 3, it will also be advantageous to provide two small, substantially vertical, profiled fins 52 toward the stern of the craft, giving more stability to the craft and, at high speed, promoting its riding out of the water, resting, essentially on fins 19, 20 and rear fins 52, enabling the craft to skim above the water.

Figure 5:
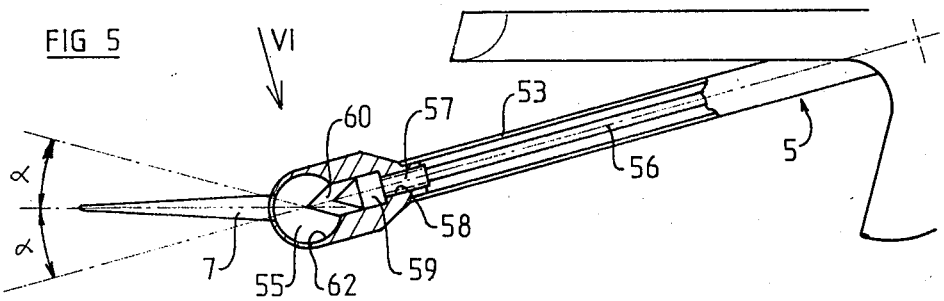
FIG. 5 shows a detail of the mounting of the dolphin-tail rudder plane.
Figure 6:
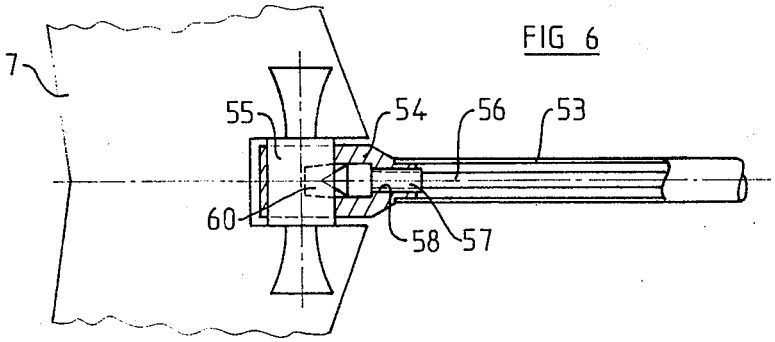
FIG. 6 shows, according to the arrow VI in FIG. 5, a detail of the mounting.

Now, with reference more particularly to FIGS. 5 and 6, there will be a description of a particular construction, used advantageously to embody the connection between the rudder plane 7 and the lower end of lever 5.

As seen above, lever 5 is mounted to pivot freely in a sleeve 36. In the embodiment illustrated in FIGS. 5 and 6, the lever is formed as a hollow tube 53 which terminates at its end in a head in the shape of a pestle 54. This pestle is traversed by a pivot 55, suitably anchored in the rudder plane 7.

Inside tube 53 there is mounted a rod 56 which can be controlled in rotation independently of tube 53, for example by a small crank (not shown) emerging at 61 (FIG. 2) on the handle. At its lower end, rod 56 has a thread 57 that screws into a threaded surface 58 corresponding with tube 53. On the other hand, at the end of a rod 56 a wedge 59 is formed, which, depending on whether tube 53 is screwed home on screw 57, or is unscrewed, either engages or does not engage in a triangular recess 60 formed on pivot 55. The importance and the working of this device will now be explained.

When rod 56 with its screw 57 and its wedge-shaped end 59 is screwed home in the interior of the threaded surface 58 of tube 53, wedge 59 engages in the groove or slot 60 in pivot 55, locking the latter in rotation in its surface 62 inside the pestle-shaped head 54 of tube 53. In this position, rudder plane 7 is therefore integral with tube 53, relative to which it has no degree of freedom. The rudder plane, under these conditions fulfills its essential function as rudder for the craft.

But, on rotating rod 56 inside tube 53, it is possible, by turning screw 57 in the threaded surface 58, to cause wedge 59 to rise inside head 54 and partially disengage the point of the wedge 59 from groove 60 as illustrated in FIG. 5. In such a position, it appears that rudder plane 7 can swing over a certain angle alpha on either side of its normal direction x'—x when the plane is locked when wedge 59 is pressed into the inside of groove 60 in pivot 55.

The size of angle alpha can be regulated by screwing or unscrewing, to a greater or lesser degree, rod 56 inside tube 53. Preferably, this angle alpha is selected between 0° and 30°.

When such a swing of rudder plane 7 is permitted, it is possible, by operating lever 5 alternately downward (up and down) as shown by the double arrow 39 (FIG. 3), to cause the craft to move forward under the influence of the water which is alternately driven by the lower face of plane 7 or by its upper face which automatically orients itself in such a way as to produce the best effect of thrust on the craft. This device therefore makes it possible to maneuver the craft in a port, or cause it to move forward in spite of all when there is no wind.

It appears that the craft according to the invention insures automatically, by the effect of the inclination of the mast controlling the craft-righting fins, a quasi-automatic maintenance of the list, and the pilot, by acting on the rudder plane 7, can select his direction but also influence the list of the craft and its "grip" in the water, or, on the contrary, its righting out of the water, borne by its fins alone.

Moreover, the action of the sail sheets on the arms 34, 35 diminishes the rudder effect tending automatically to lower the lever so that the boat will restore the nose always tending to rise on its fins.

By a 180° turn of the lever, the pilot obtains a powerful braking action, the rudder plane, in such a position, also forming a veritable drogue anchor.

When running before the wind or with a quartering wind, when both sail parts are spread, the vent channels provided in the center of the sails prevent any unbalance of the sail, not having the faults of so-called "ballon sails" which are very difficult to control.

The invention, of course, is not limited to the method of embodiment illustrated and described, which was given only by way of example, the invention comprising all technical equivalents of the means described, as well as their combinations if the latter are embodied in the spirit thereof, and applied within the scope of the claims which follow. In particular, the two stern fins 52 can be replaced by two fins whose terminal edges are inclined toward one another, perhaps until they touch one another, and on which the craft will be raised at high speed.

I claim:

1. Sailing craft of the type including a floating hull, a mast secured on the hull, a sail mounted on the mast, and a rudder means, comprising: said mast being pivotally mounted with an articulation near but spaced from its base with respect to a substantially horizontal axis wherein when the mast pivotally oscillates around its axis of articulation, the base of the mast moves substantially transversely from port to starboard, a pair of mobile fins having variable lift movably mounted, each on a respective one of the port and starboard sides of the hull, and means interconnecting said mast and the mobile fins for actuation of the mobile fins, such that the fins act in the water in such a way as to tend under dynamic action of water on the fins to right the hull in a direction opposite to the direction in which the mast pivots, and in which the craft would normally heel under the action of just the wind to which it is exposed, said actuation means comprising a transverse bar in which the base of the mast is entrained, at each end of which there is articulated one end of a connecting rod, whereof the end of the connecting rod opposite the articulation on the said transverse bar is integral with a substantially vertical pivot articulated in a structural element fixed to the hull and around which one said fin, on the port or starboard side, respectively, can rotate.

2. Craft according to claim 1, characterized in that in a substantially vertical position of the mast, the said port and starboard fins have a substantially zero, and preferably slightly positive, lift.

3. Craft according to claim 1 wherein a position of the mast inclined to port, the said port fin has a substantially positive lift while the said starboard fin has a substantially negative lift, and likewise, in a position of the mast inclined to starboard, the said port fin has a substantially negative lift while the said starboard fin has a substantially positive lift.

4. Craft according to claim 3 wherein the angle of rotational swing of each of the said port or starboard fins is in the range of about 15° to 45°.

5. Craft according to claim 4, wherein the angle of swing is limited by elastic means supported and rotated like the said fins, on said pivots on which said fins are supported, and swinging between two stops fixed to structures of the hull.

6. Craft according to claim 5, wherein said elastic means are constituted by inflatable tires and the said fins are each articulated around a second substantially horizontal pivot, passing through the said substantially vertical pivot, thereby permitting, in position of transportation over the ground, the said fins to be raised and using the said tires as means to support the craft and run it along the ground.

7. Sailing craft of the type including a floating hull, a mast secured on the hull, a sail mounted on the mast, and a rudder means, comprising: said sail comprises two substantially symmetrical, triangular parts fixed to said mast with a sheet for holding each sail, attached to the lower free end of the sail not fixed to the mast, each sheet passing over a pulley fixed at the end of an arm that can be oriented to port or to starboard, said mast being pivotally mounted with an articulation near but spaced from its base with respect to a substantially horizontal axis, a pair of mobile fins having variable lift movably mounted, each on a respective one of the port and starboard sides of the hull, and means interconnecting said mast and the mobile fins for actuation of the mobile fins such that the fins act in the water in such a way as to tend under dynamic action of water on the fins to right the hull in a direction opposite to the direction in which the mast pivots, and in which the craft would normally heel under the action of just the wind to which it is exposed.

8. Craft according to claim 7 wherein said arms are fixed at the end opposite the one bearing the sheet guide pulley, onto a sleeve in which said lever is rotatably mounted.

9. Craft according to claim 7 wherein each sail part is attached to the mast over short lengths alternating with one another, without leaving substantially free attachment space on the mast, and defining, when the two parts are spread out, one to port, the other to starboard, vent channels for the wind between each sail part and the mast, between two consecutive attachment parts of a given sail part, and not leaving any vent between the mast and the two sail parts when the latter are folded on one another to port or to starboard.

10. Sailing craft of the type including a floating hull, a mast secured on the hull, a sail mounted on the mast, and a rudder means, comprising: said mast being pivotally mounted with an articulation near but spaced from its base with respect to a substantially horizontal axis, a pair of mobile fins having variable lift movably mounted, each on a respective one of the port and starboard sides of the hull, and means interconnecting said mast and the mobile fins for actuation of the mobile fins such that the fins act in the water in such a way as to tend under dynamic action of water on the fins to right the hull in a direction opposite to the direction in which the mast pivots, and in which the craft would normally heel under the action of just the wind to which it is exposed, and further including a lever articulated around a horizontal axis in the median longitudinal plane of the craft and toward its stern part, and which can rotate on itself, the said lever terminating at its upper end above the hull in an operating handle, and at its lower end, below the hull, in a plane in the general shape of a dolphin's tail.

11. Craft according to claim 10 wherein the said plane in the general shape of a dolphin's tail is mounted at the end of the said operating lever articulated around an axis perpendicular to the axis of the lever, and locking means are provided to lock the said plane around the said axis, or to unlock it and permit a limited swinging movement of the said plane around the said axis perpendicular to the axis of the lever.

* * * * *